US006190088B1

(12) United States Patent
Van Der Hidde et al.

(10) Patent No.: US 6,190,088 B1
(45) Date of Patent: Feb. 20, 2001

(54) DEVICE FOR FORMING A SAND BODY AND METHOD FOR THE APPLICATION THEREOF

(76) Inventors: Martien Wilfrid Van Der Hidde; Adriana Bijl, both of Gerben Oswaldstraat 19, Harlingen NL-8861 TV (NL)

( * ) Notice: Under 35 U.S.C. 154(b), the term of this patent shall be extended for 0 days.

(21) Appl. No.: 09/355,116

(22) PCT Filed: Jan. 21, 1998

(86) PCT No.: PCT/IB98/00148

§ 371 Date: Jul. 21, 1999

§ 102(e) Date: Jul. 21, 1999

(87) PCT Pub. No.: WO98/32926

PCT Pub. Date: Jul. 30, 1998

(30) Foreign Application Priority Data

Jan. 22, 1997 (NL) ..... 1005063
Sep. 11, 1997 (NL) ..... 1007013

(51) Int. Cl.[7] ..... E02B 3/04; E02B 3/12; E02B 8/02

(52) U.S. Cl. ..... 405/19; 405/16; 405/25; 405/74

(58) Field of Search ..... 405/15, 21, 23–26, 405/28, 74, 115, 16, 17, 19

(56) References Cited

U.S. PATENT DOCUMENTS

| | | | | |
|---|---|---|---|---|
| 4,102,137 | * | 7/1978 | Porraz et al. | 405/18 |
| 4,171,174 | * | 10/1979 | Larsen | 405/25 |
| 4,437,786 | * | 3/1984 | Morrisroe | 405/24 |
| 4,490,071 | * | 12/1984 | Morrisroe | 405/24 |
| 4,534,675 | * | 8/1985 | Morrisroe | 405/24 |
| 4,641,997 | * | 2/1987 | Lauer et al. | 405/24 |
| 5,176,468 | * | 1/1993 | Poole | 405/23 |
| 5,257,878 | * | 11/1993 | Peterson | 405/15 |
| 5,405,217 | * | 4/1995 | Dias et al. | 405/25 |
| 5,575,584 | * | 11/1996 | Alsop | 405/24 |
| 5,660,505 | * | 8/1997 | Emory, III | 405/15 X |
| 5,807,024 | * | 9/1998 | Benedict | 405/21 X |

FOREIGN PATENT DOCUMENTS

| | | |
|---|---|---|
| 6806843 | 1/1969 | (NL) . |
| 9101525 | 4/1993 | (NL) . |

* cited by examiner

*Primary Examiner*—Eileen D. Lillis
*Assistant Examiner*—Tara L. Mayo
(74) *Attorney, Agent, or Firm*—Edwin D. Schindler

(57) ABSTRACT

A device for forming a siltation construction comprising a substantially rectangular cloth (1) of water-permeable material, which is anchored on all sides to a water bed by anchoring means. Floating elements (10) are arranged on cloth at a distance from one side (4) thereof and along the other sides (3) are formed pouches (1) open toward the center of the cloth.

10 Claims, 3 Drawing Sheets

DEVICE FOR FORMING A SAND BODY AND METHOD FOR THE APPLICATION THEREOF

BACKGROUND OF THE INVENTION

1. Technical Field of the Invention

The invention relates to a device for forming a siltation construction comprising a substantially rectangular cloth of water-permeable material. Such a cloth is anchored on all sides with anchoring means to a water bed and floating means are arranged on the cloth which pull the cloth upward relative to the bed.

2. Description of the Prior Art

Such a device is known from the Netherlands patent application 9101525.

SUMMARY OF THE INVENTION

The invention has for its object to further improve a device as known from the prior art such that in more efficient manner a siltation construction can therewith be formed and preserved in durable manner.

This object is achieved with the device according to the invention in that the floating means are arranged at a distance from one side of the cloth and along the other sides are formed pouches open toward the centre of the cloth. The cloth is anchored to the water bed by the anchoring means with the open side of the pouches facing upward. A water flow filled with sediment which moves along the cloth will also flow into the open pouches and come to rest there locally. The sediment hereby settles in and around the pouches. Within a very short time the sides of the cloth where the pouches are situated are thus incorporated in the water bed in well closed-in manner.

The side of the cloth not provided with pouches is anchored at some distance. The floating means arranged close to this side hold up this side of the cloth, hereby water charged with sand and optionally other sediment can flow into the space beneath the cloth. Because the flow becomes calmer here, the sediment will settle and the desired siltation construction will thus be formed.

Because the floating means are arranged on the underside of the cloth in the situation of use, they are situated in a relatively calm environment, so that they do not suffer damage. The upper side of the cloth herein remains smooth, whereby a uniform flow occurs over the cloth.

An advantageous method of fixing the floating means is to accommodate them in a tunnel which is sewn onto the cloth parallel to the one side of the cloth not provided with the pouches. The floating means can then be pushed into and later optionally also pushed out of this tunnel.

A further very favourable development of the invention is obtained by a closing cloth connected to the cloth at a distance parallel to the one side thereof and having a dimension transversely of the connecting side larger than this distance. After sufficient sediment has been deposited beneath the cloth, or optionally in the interim, this closing cloth can be laid over the open side of the cloth and anchored to the bed. The formed sand body is hereby protected and enclosed on all sides by the cloth and the closing cloth.

Preferably applied herein along the side of the closing cloth opposite the connecting side are pouches which are open toward the connecting side. In the situation where the closing cloth is laid over the opening, these pouches will also become filled with sediment and be incorporated in the bed, whereby here also a good closing-in is effected. Later washing away of the sand body is hereby prevented to a large degree.

The device can further comprise fixing means for fastening the closing cloth in rolled-up position. As long as siltation still takes place and the one side of the cloth therefore remains open, the closing cloth can be fastened with these fixing means.

Another favourable embodiment is obtained when additional floating means are arranged along the side of the closing cloth opposite the connecting side. The closing cloth can hereby stand vertically upward in the siltation phase. On the one hand the free side of the cloth fixed to the bed is hereby held up and on the other hand the upright closing cloth forms a flow barrier which contributes toward calming of the water flow and thereby toward settling of the sediment in this water.

The floating means are accommodated in favourable manner in a tunnel which is sewn onto the free end of the closing cloth. Once the siltation phase has ended, the floating means can then be removed simply from the tunnel by a diver, whereafter the closing cloth can be secured.

It is noted that if the closing cloth is provided along the free edge with the above described pouches open on one side, these pouches will be open downward in the vertically upright position of the closing cloth, so that in this situation no sediment can accumulate in these pouches. Only when the closing cloth has been folded over the opening and the pouches therefore assume a substantially lying position will they quickly be filled with sediment and provide the desired closing-in.

The invention likewise relates to and provides a method for forming a sand body on a bed of a body of water in which a sediment-charged flow occurs. In this method a plurality of the above described devices according to the invention are used. These are anchored mutually adjacently to the bed. One or more continuous sand bodies can thus be formed in durable manner in a flow charged with sediment.

The method is particularly suitable for preventing or reversing erosion in sea or river flows at coasts and river banks.

When the sediment-charged flow arrives via the open side under the cloth which is further held up by floating means, the speed of the flow decreases, whereby under, on and around the cloth sedimentation will occur continuously. The water, now charged to a lesser degree with sediment, will escape through the meshes of the cloth.

BRIEF DESCRIPTION OF THE DRAWING FIGURES

The invention will be further elucidated in the following description with reference to the annexed figures.

Figure 3:
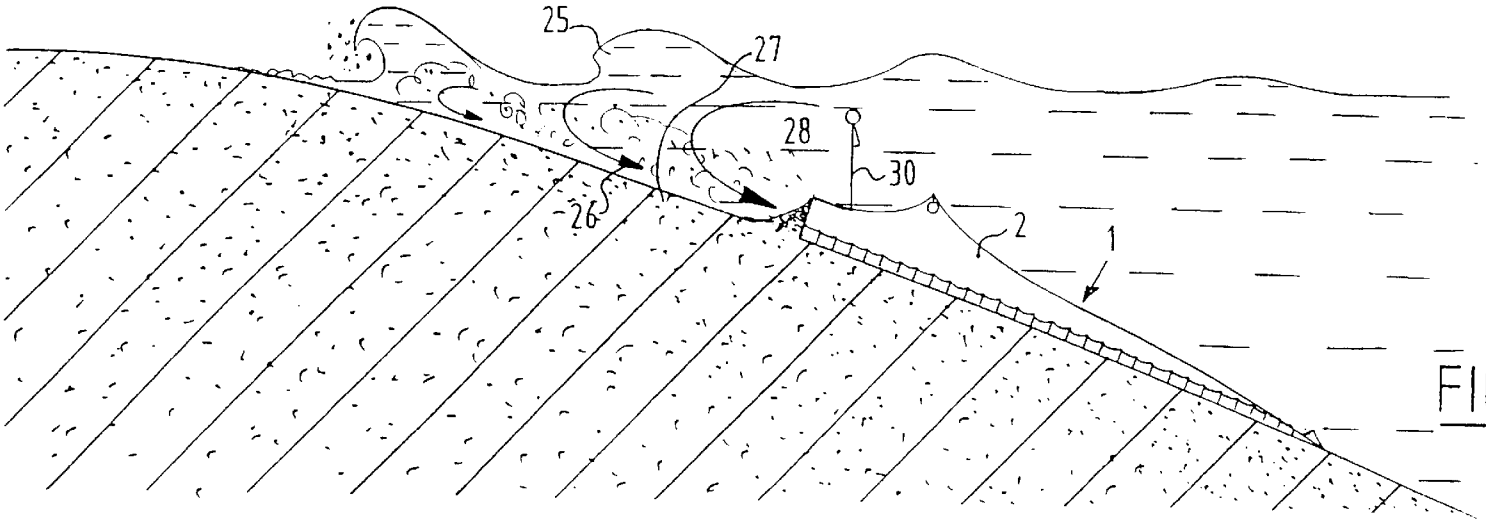
Figure 4:
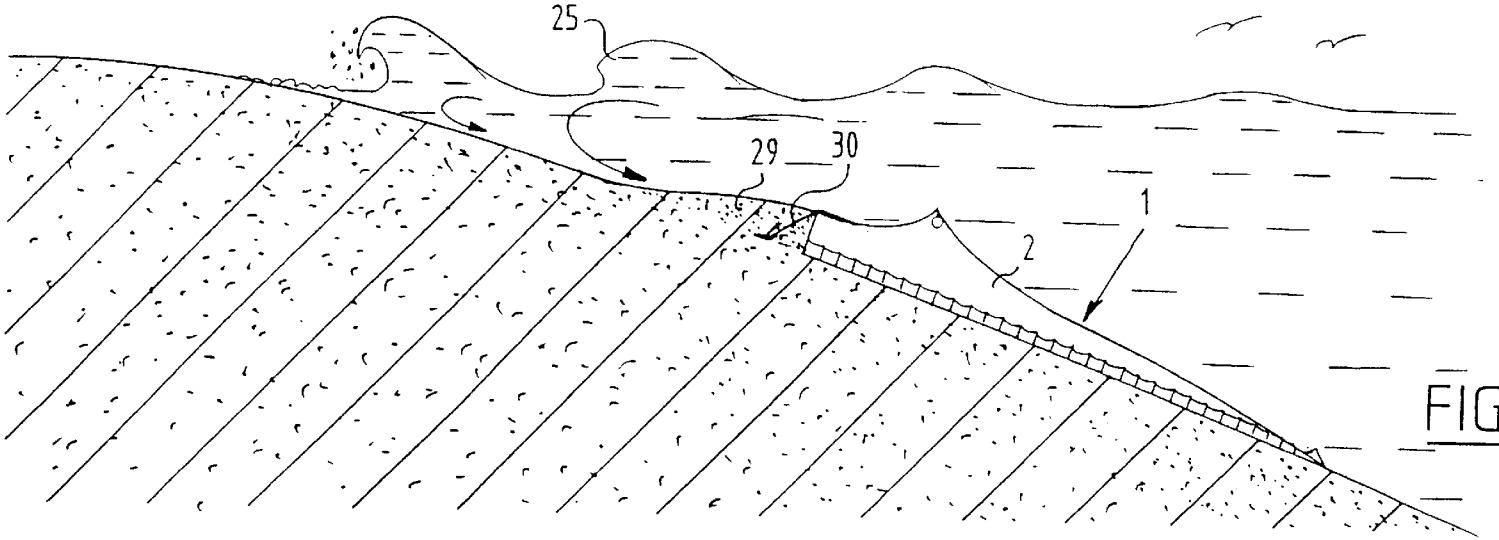

FIGS. 3 and 4 elucidate schematically the water flow during use of the method according to the invention.

DETAILED DESCRIPTION OF THE DRAWING AND PREFERRED EMBODIMENTS

Figure 1:
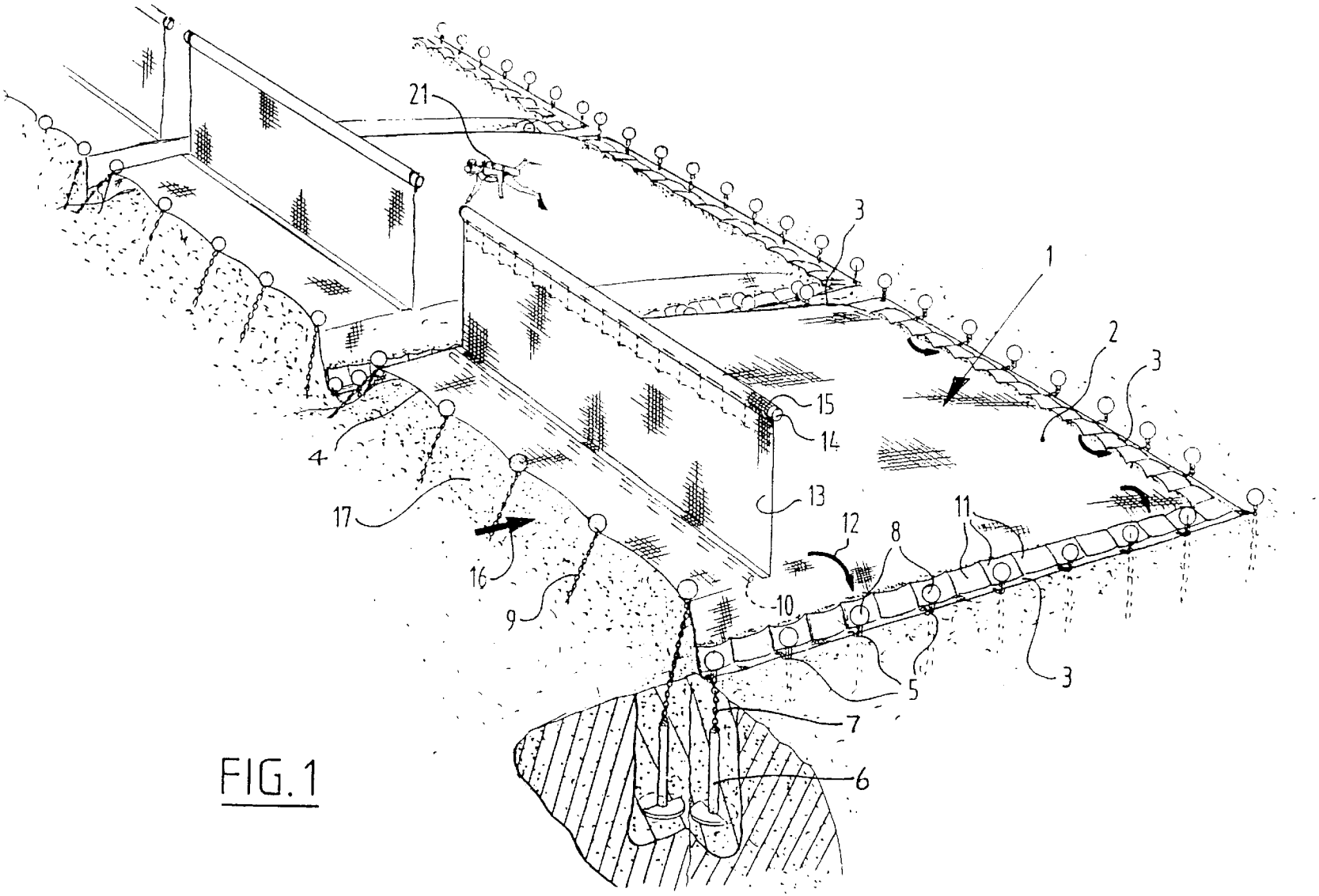
FIG. 1 shows a number of devices according to the invention for forming a sand body in the siltation phase.

Designated with 1 in FIG. 1 is a device according to the invention. This substantially comprises a rectangular cloth 2 of material which is water-permeable but the meshes of which are of dimensions such that sediment, in particular sand, cannot easily flow out through these meshes.

Along three sides 3, referred to hereinbelow as fastening edges, the cloth is secured to the bed of a body of water with anchoring means. The fourth edge 4, referred to hereinbelow as free edge, is also anchored to this bed but at some distance, so that it can remain clear of the bed.

The anchoring means are formed in this embodiment by anchors 6 which can be placed in the bed in random suitable manner. This preferably takes place by means of injection, wherein water is fed through a central tube of anchor 6 which carries away soil from beneath the anchor and thus creates space to allow anchor 6 to sink. When anchor 6 is arranged at the correct depth, the water supply is discontinued.

Arranged at the top of the tube of anchor 6 is a chain 7, on the end of which is mounted a floater 8.

All anchoring means for one cloth 2 can be arranged in advance in the bed. This can be carried out in simple manner by divers.

When the anchors are arranged, the cloth 2 is taken for instance by boat to a position above the chosen location and fixed to the anchoring means.

It is noted that the cloth is very light, for instance only 0.2 $kg/m^2$, while cloth 2 itself measures for instance 25 m×25 m, so that it can be handled easily by a few people.

The lowered cloth is fixed to the chains 7 of the anchoring means. The floating bodies 8 herein serve of course to enable locating of the ends of chains 7.

As noted, the free edge 4 of cloth 2 is fastened at a greater distance, in that chains 9 have a greater length than chains 7. On the underside of cloth 2 close to free edge 4 a floating body 10 is accommodated in a tunnel formed for this purpose on the underside of cloth 2. This floater 10 ensures that free edge 4 is held up at a distance from the bed. Water charged with sediment, particularly sand, can flow through below free edge 4 in the direction of arrow 16 beneath the cloth 2, where the flow will become considerably calmer and the sediment will settle. The water escapes through cloth 2.

Formed along the fastening edges 3 of cloth 2 are pouches 11 which are open toward the centre of the cloth. These pouches 11 will likewise be filled with sediment by water flows indicated with arrows 12 whereby fastening edges 3 are thus made heavier and close well against the bed. Through siltation all around the fastening edge 3 will gradually be incorporated into the bed.

In the shown preferred embodiment a closing cloth 13 is fixed to the cloth 2 at a distance parallel to free edge 4. This closing cloth 13 is a rectangular piece of cloth which in this embodiment has on its free upper edge a tunnel 15 in which a floater 14 is received. Due to the buoyancy of this floater 14 the cloth 13 will assume the upright position shown in FIG. 1. The upright closing cloth 13 reduces the flow over the surface of cloth 2, which contributes toward settling of the sediment taken up in the flowing water.

FIG. 3 shows more particularly a side view of an array of devices 1 according to the invention which are arranged in the vicinity of a coastline. It is known that through the surging movement of waves 25 the bed 27 can be considerably washed away and the coastline can thus be eroded significantly in a short time. In order to prevent this an array of devices 1 as shown in FIG. 1 is arranged mutually adjacently and substantially parallel to the coastline, in order to form a natural sandbank in durable manner with the sedimentation enhanced by the cloth which prevents further erosion of the coast.

Sediment from the bed 27 is carried along in large quantities by the breaking waves 25 in the return flow 26. This return flow 26 is captured by the free opening 28 of the mutually adjacent devices 1. The sediment taken up in the flow settles beneath the cloth of device 1 whereby the desired, naturally formed, durable sandbank is formed. After the space under the cloth is completely filled with sediment, the closing cloth 29 is closed over free opening 28, whereafter further siltation 29 as shown in FIG. 4 will occur, resulting in a durable sandbank in a natural streamlined shape for protection of the coastline. The strength of the surging movement is reduced by the thus formed sandbank and further bed erosion is prevented, while siltation between the sandbank and the coast will be enhanced.

Figure 2:
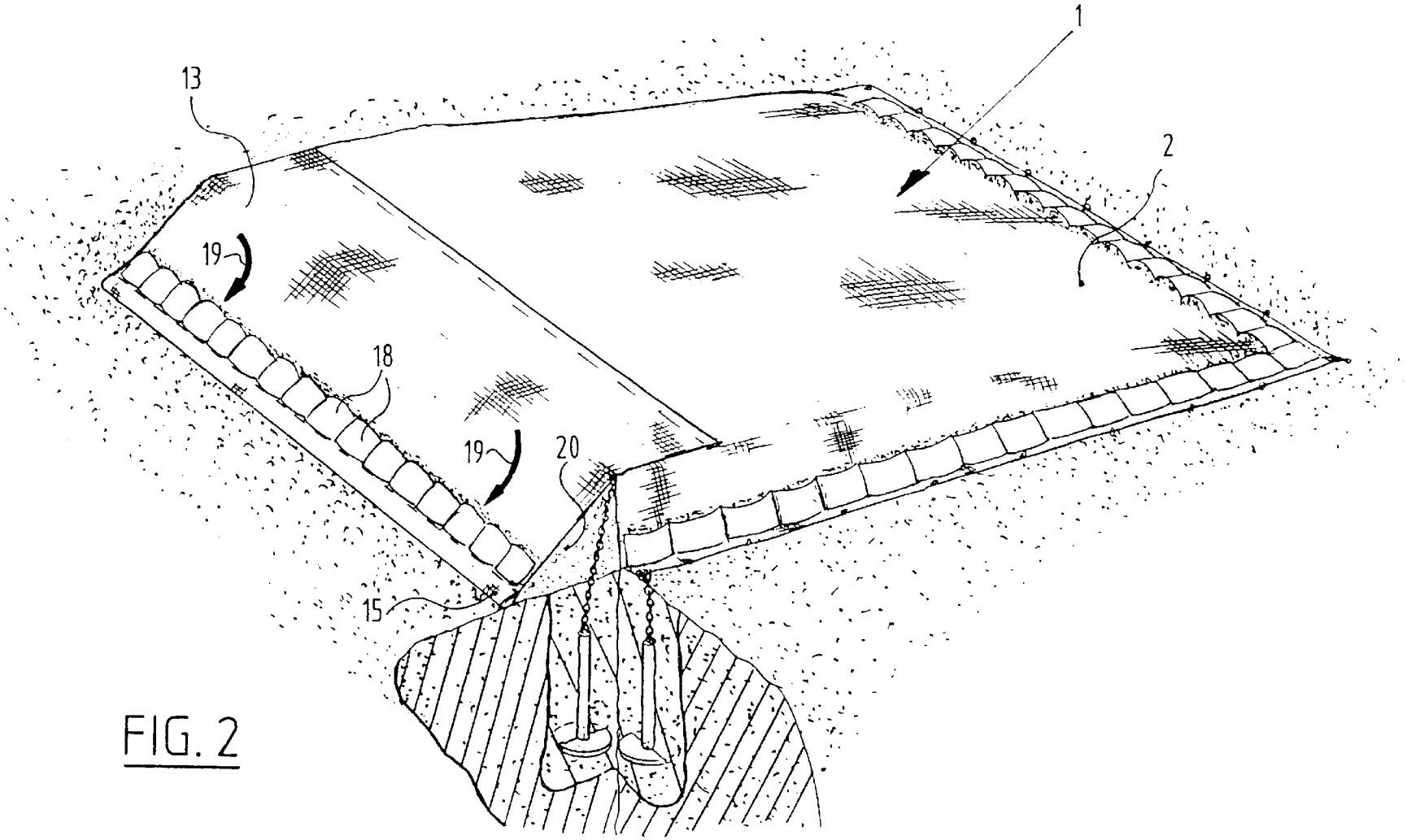
FIG. 2 shows one of the devices according to the invention shown in FIG. 1 after siltation is completed.

FIG. 2 shows in more detail a device 1 according to the invention, wherein closing cloth 13 is folded over the opening and thus covers it.

When sufficient sediment has thus deposited under cloth 2, a diver 21 removes the floater 14 from the tunnel 15 on the end of closing cloth 13. Closing cloth 13 is subsequently folded over the opening in the manner shown in FIG. 2 and fastened using anchoring means which are not shown in detail here.

As shown in FIG. 2, the free edge of closing cloth 13 is provided with pouches 18 which are gradually filled with sediment in the same manner as pouches 11 and thus hold the free edge of closing cloth 13 in firm contact with the bed and are subsequently entirely incorporated therein. In the situation shown in FIG. 2 the formed siltation construction is protected against damage by unexpected influences, such as extra-strong surge and eroding currents.

What is claimed is:

1. A device for forming a siltation construction comprising a substantially rectangular cloth of water-permeable material, anchoring means for anchoring the cloth on all sides to a water bed, wherein floating means are arranged on the cloth at a distance from one side of said cloth and wherein along the other sides of said cloth are formed pouches having openings facing toward the center of the cloth.

2. The device as claimed in claim 1, wherein the floating means are arranged on a surface of the cloth opposite the surface of the cloth on which the pouches are formed.

3. The device as claimed in claim 2, wherein the floating means are accommodated in a tunnel which is sewn onto the cloth and parallel to the one side.

4. The device as claimed in claim 1, further comprising a closing cloth connected at a distance to the cloth parallel to the one side of the cloth and having a dimension extending transversely of the connecting side, wherein said dimension is longer than said distance.

5. The device as claimed in claim 4, further including additional pouches on said closing cloth wherein said additional pouches are formed along the side of the closing cloth lying opposite the connecting side.

6. The device as claimed in claim 4, wherein fixing means are provided for fastening the closing cloth in rolled-up position.

7. The device as claimed in claim 4, wherein additional floating means are arranged along the side of the closing cloth opposite the connecting side.

8. The device as claimed in claim 7, wherein the additional floating means are accommodated in a tunnel sewn onto the cloth.

9. A method for forming a sand body on a bed of a body of water in which a sediment-charged flow occurs, utilizing a plurality of devices, each of said devices including:

a substantially rectangular cloth of water-permeable material;

anchoring means for anchoring the cloth on all sides to a water bed; and, floating means being arranged on said cloth at a distance from one side thereof and wherein along remaining sides of said cloth, pouches are formed open toward a central point of said cloth, comprising the step of:

anchoring said plurality of devices mutually adjacently to the bed.

10. The method as claimed in claim 9, wherein each said plurality of devices is provided with a closing cloth, and further including after forming the sand body, folding said closing cloth of each of said plurality of devices over said one side and anchoring each said closing cloth to the bed.

* * * * *